US007959504B2

(12) United States Patent
Baumgartner et al.

(10) Patent No.: US 7,959,504 B2
(45) Date of Patent: Jun. 14, 2011

(54) GAMING DEVICE GAME APPLYING RANDOMLY SELECTED FEATURES TO AN ARRAY OF SYMBOLS

(75) Inventors: Christian Baumgartner, Oberndorf (AT); Andreas Zehetner, Graz (AT)

(73) Assignee: Atronic International GmbH, Lübbecke (DE)

( * ) Notice: Subject to any disclaimer, the term of this patent is extended or adjusted under 35 U.S.C. 154(b) by 920 days.

(21) Appl. No.: 11/565,502

(22) Filed: Nov. 30, 2006

(65) Prior Publication Data

US 2008/0132309 A1 Jun. 5, 2008

(51) Int. Cl.
*A63F 9/24* (2006.01)

(52) U.S. Cl. ..... 463/20

(58) Field of Classification Search ..... 463/16, 463/20

See application file for complete search history.

(56) References Cited

U.S. PATENT DOCUMENTS

2005/0054419 A1* 3/2005 Souza et al. ..... 463/20
2006/0068892 A1* 3/2006 Gomez et al. ..... 463/20
2006/0084498 A1* 4/2006 Baerlocher et al. ..... 463/20
2006/0189377 A1* 8/2006 Gomez et al. ..... 463/20
2007/0060245 A1* 3/2007 Veenker ..... 463/16

FOREIGN PATENT DOCUMENTS

WO WO 2004057499 A2 * 7/2004

* cited by examiner

*Primary Examiner* — David L Lewis
*Assistant Examiner* — Werner Garner
(74) *Attorney, Agent, or Firm* — Patent Law Group LLP; Brian D. Ogonowsky

(57) ABSTRACT

Disclosed herein is a game played on a gaming device that displays a randomly selected array of symbols, where the symbols across one or more paylines are evaluated by circuitry to determine an award to be granted. A trigger event, such as the occurrence of a special symbol (e.g., a $ symbol), initiates a special feature. Once the trigger event occurs, one of a plurality of features is randomly selected and applied to the symbols in the existing array of symbols, and an award is then granted based on the results. An example of the group of available features is: 1) multiply the number of $ symbols in the array by X credits; 2) randomly place a $ symbol on reels 1, 2, 4, and 5; 3) change certain predetermined symbols to the $ symbol; and 4) fill two, three, or four reels (randomly selected) with the $ symbol.

8 Claims, 8 Drawing Sheets

GAMING DEVICE GAME APPLYING RANDOMLY SELECTED FEATURES TO AN ARRAY OF SYMBOLS

FIELD OF THE INVENTION

This invention relates to gaming devices, such as slot machines, and, in particular, to additional features performed in a game that grants awards to a player based upon displayed symbols.

BACKGROUND

Common slot machines randomly select and display an array of symbols on a video screen, then grant an award to a player based on the occurrence of certain symbol combinations across paylines. Typically, the game ends after the symbols are displayed and the award, if any, is granted. Although these types of games are highly successful, it is advantageous to provide an additional feature to this basic game to make the game more interesting to a player. A more interesting game will generate increased revenue to the casino by its increased play.

SUMMARY

Disclosed herein is a game played on a gaming device that displays a randomly selected array of symbols, such as a video slot machine or a video monitor connected to a computer for on-line gaming. In one embodiment, the array is 5×3 symbol positions. The combinations of symbols across one or more activated paylines are evaluated by a processor to determine an award to be granted. The present invention adds an additional feature to this conventional operation of a gaming machine.

In one embodiment of the present invention, a trigger event initiates the special feature. In one example, the trigger event is a special symbol occurring on the middle reel in the middle position. Once the trigger event occurs, one of a plurality of features is randomly selected and applied to the symbols in the existing array of symbols.

It will be assumed that the trigger symbol is a "$" symbol at the middle position of reel 3. An example of the group of available features is: 1) multiply the number of $ symbols in the array by X credits; 2) randomly place a $ symbol on reels 1, 2, 4, and 5; 3) change certain predetermined symbols to the $ symbol; and 4) fill two, three, or four reels (randomly selected) with the $ symbol. Once one of the four features is selected, the feature is applied to the existing array of symbols, and an award is paid to the player based on the resulting combination of symbols or based on another factor relevant to the feature. For example, different awards are granted for different numbers of $ symbols across an activated payline.

Other types of features may also be available, and other trigger events (such as a mystery trigger) are possible.

DETAILED DESCRIPTION

The invention can typically be implemented by installing a software program in a modern video gaming machine.

Figure 1:
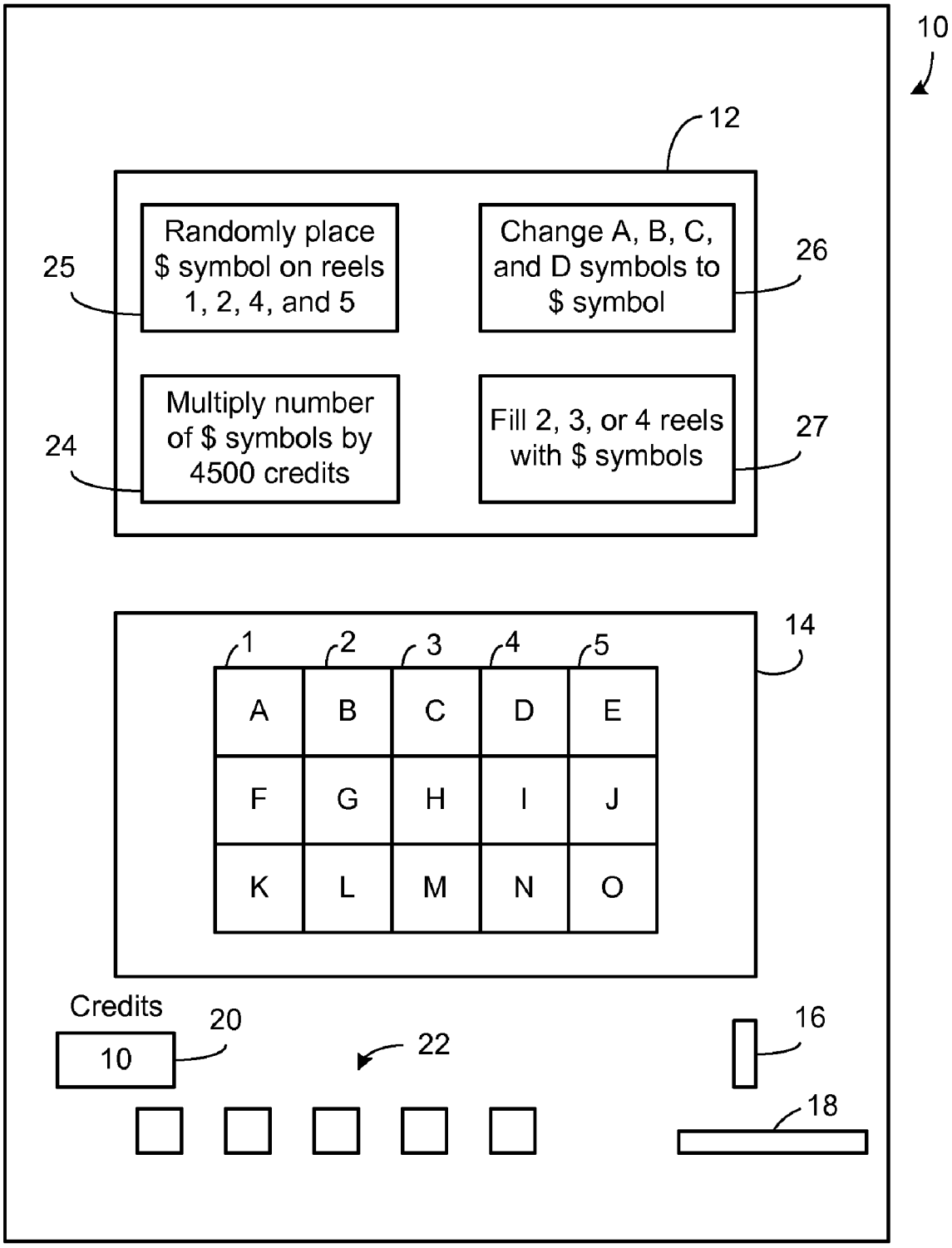
FIG. 1 illustrates a gaming machine that displays a 5×3 array of symbols and the possible features that may be selected upon a trigger event occurring, in accordance with one embodiment of the present invention.

FIG. 1 is a simplified front view of a video slot machine 10. Many other types of platforms may be used instead to implement the invention. The slot machine 10 has an upper video screen 12 and a lower video screen 14. Each screen may be a thin film transistor (TFT) display, a liquid crystal display (LCD), a cathode ray tube (CRT), or any other type of display. In another embodiment, a single screen displays all the information needed to play the game.

A coin slot 16 receives coins or tokens, and a bill slot 18 receives bills or coupons. A separate slot may dispense payment coupons for cashless gaming, and/or a coin tray (not shown) may receive coins upon the player cashing out via a coin hopper.

Prior to cashing out, awards are typically granted to the player by incrementing a credit counter 20. Control buttons 22 allow the player to spin the simulated reels, make bets, cash out, or enter other conventional instructions.

One example of the game will be described with respect to the figures.

In FIG. 1, the player has inserted a bet or has credits remaining. The credit meter 20 shows that the player has 10 credits to play the game. The lower screen 14 depicts five simulated reels 1-5 forming five columns and three rows of symbols to create a 5×3 array of symbols. The 5×3 array shows the symbols A-O from a previous game, where the player did not obtain a trigger event for initiating the inventive feature. In the example, it is assumed that the trigger event is a $ symbol on the center reel 3 in the middle position. Randomly selecting the symbol array on the lower screen 14 is referred to as the base game.

Although symbols A-O are used for simplicity, standard symbols include fruit symbols and symbols associated with the theme of the particular slot machine. The particular icons used are not important. For amusement, each vertical column of symbols is scrolled to emulate a motor-driven reel, and each of the virtual reels is typically stopped in sequence after a few seconds to reveal the final 5×3 array of symbols.

The upper screen 12 shows the various features 24-27 available to the player upon obtaining a trigger event. The upper screen 12 may instead initially show all the available winning symbol combinations and the awards as a static display and then show the features once the trigger event occurs. A display glass may also show the winning symbol combinations and awards.

Figure 2:
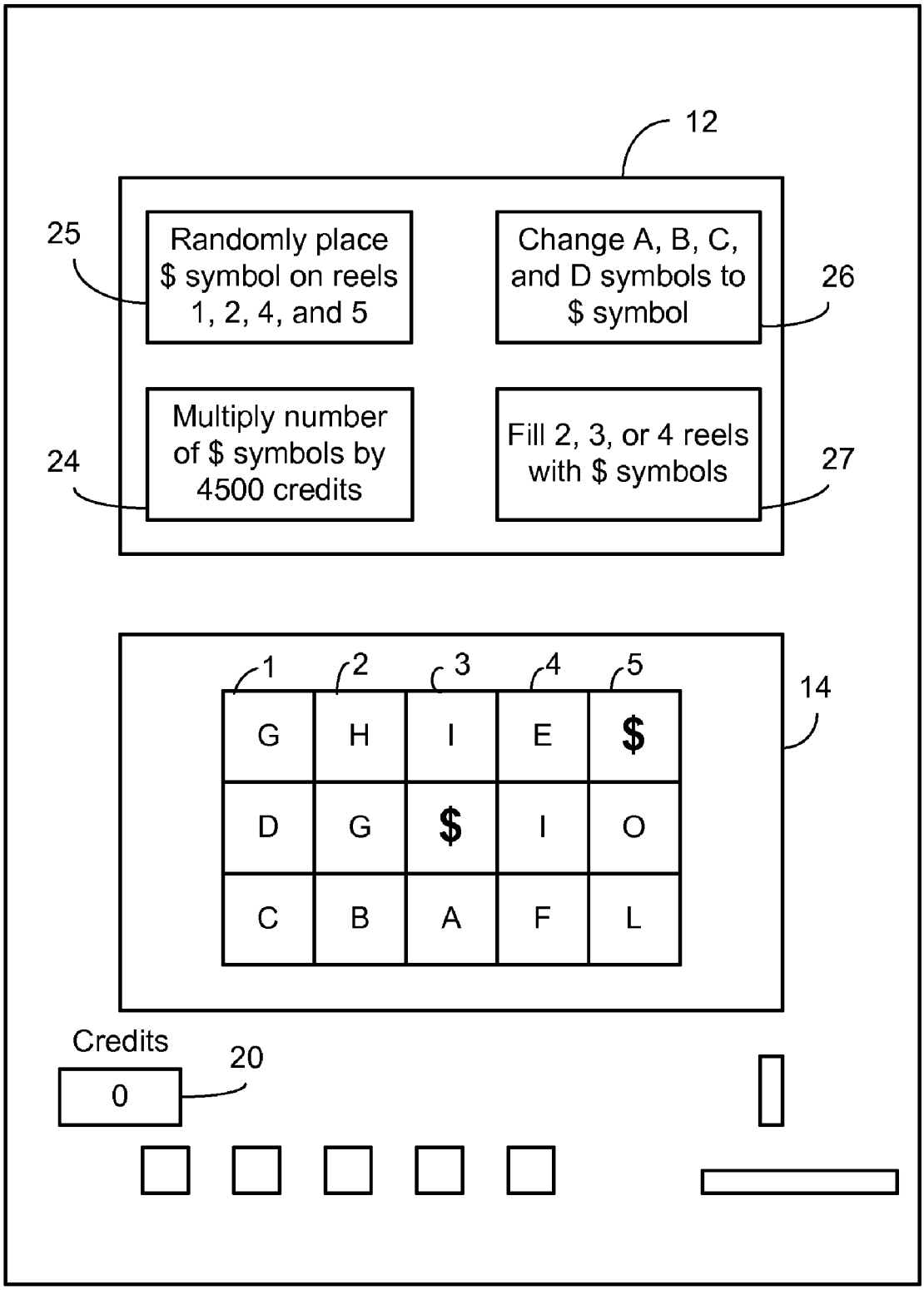
FIG. 2 illustrates the machine of FIG. 1 after the machine displays a trigger event (a center $ symbol) in the base game.

After the player makes the bet (assume 10 credits) and optionally selects paylines using the control buttons 22, the five reels spin and randomly stop. Although a pseudorandom algorithm is typically used in gaming machines, the term "random" is used herein to mean either pseudorandom or random. FIG. 2 illustrates the new 5×3 array of symbols that result from the stopped reels. The player is awarded for any winning symbol combinations in the base game prior to any feature game occurring. A trigger event occurred in FIG. 2 since a $ symbol appears on reel 3 at the middle position. The $ symbol appearing in the center position is sensed by a microprocessor in the slot machine, and the microprocessor initiates the feature game. In the present example, the slot machine randomly selects one of the four possible features shown on the upper screen 12.

These features 24-27 are: 1) multiply the number of $ symbols in the array by 4500 credits; 2) randomly place a $ symbol on reels 1, 2, 4, and 5; 3) change each A, B, C, and D symbol in the base game to the $ symbol; and 4) fill two, three, or four reels (randomly selected) with the $ symbol. In one embodiment, the multiplier for each $ symbol in feature 24 is randomly selected upon the trigger condition occurring. The player may witness the multiplier changing and stopping at the final multiplier.

To start the random selection of the feature, the screen may instruct the player to touch the center position. The lower screen 14 may be a touch screen, generating signals for controlling the microprocessor.

Figure 3:
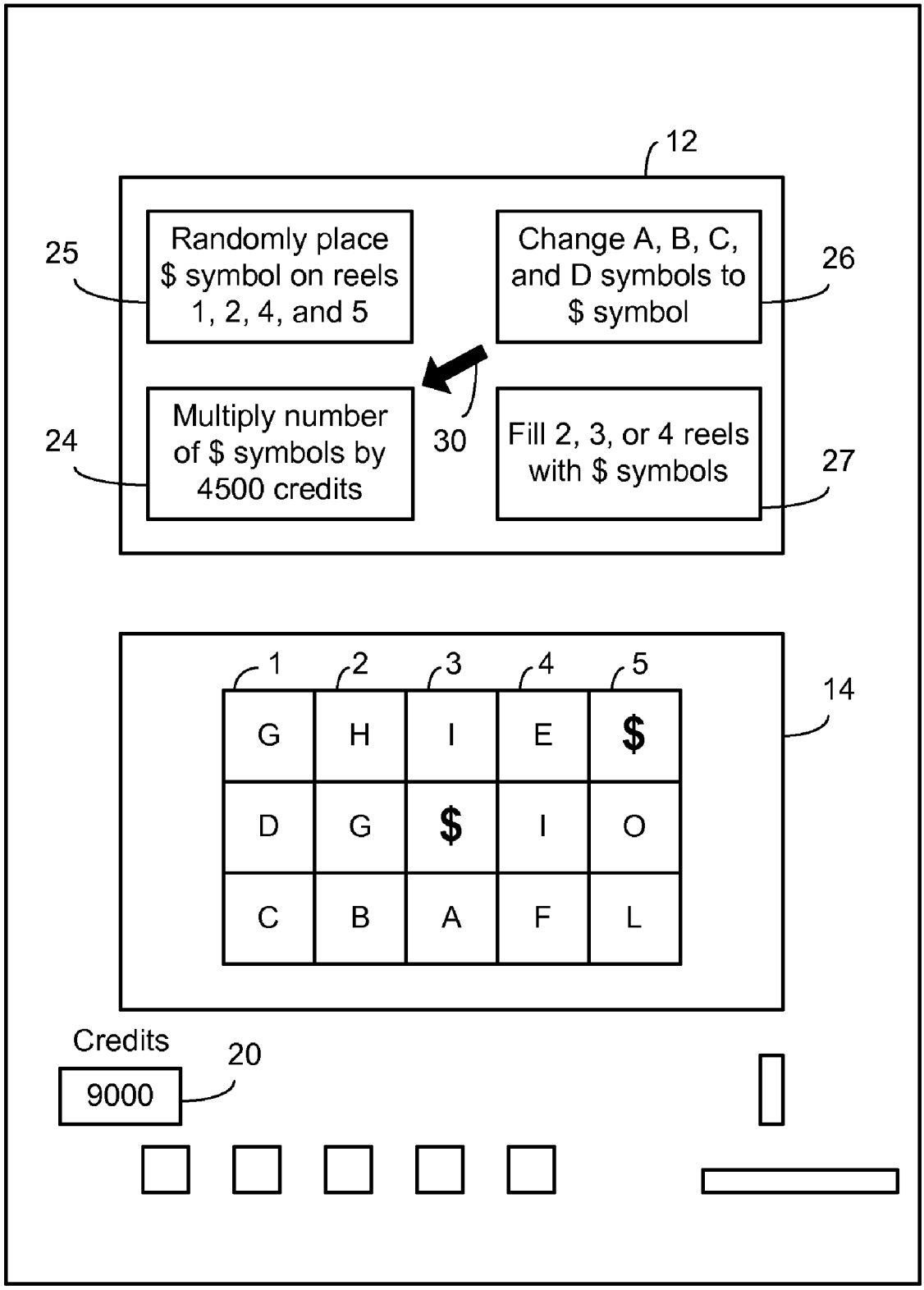
FIG. 3 illustrates the machine of FIG. 2 after one of the four possible features is randomly chosen by a selector and the selected feature is applied to the existing array of symbols from the base game of FIG. 2.

As shown in FIG. 3, a selector arrow 30 appears in the upper screen 12 and rotates like a spinner to randomly select one of the features. The arrow is shown stopped when pointing to the multiplying feature 24. Since the 5×3 array shows two $ symbols, the two occurrences are multiplied by 4500 credits, and the player is awarded 9000 credits, shown on the credit meter 20.

The feature game is then over, and the player must bet additional credits to play a new base game.

Figure 4:
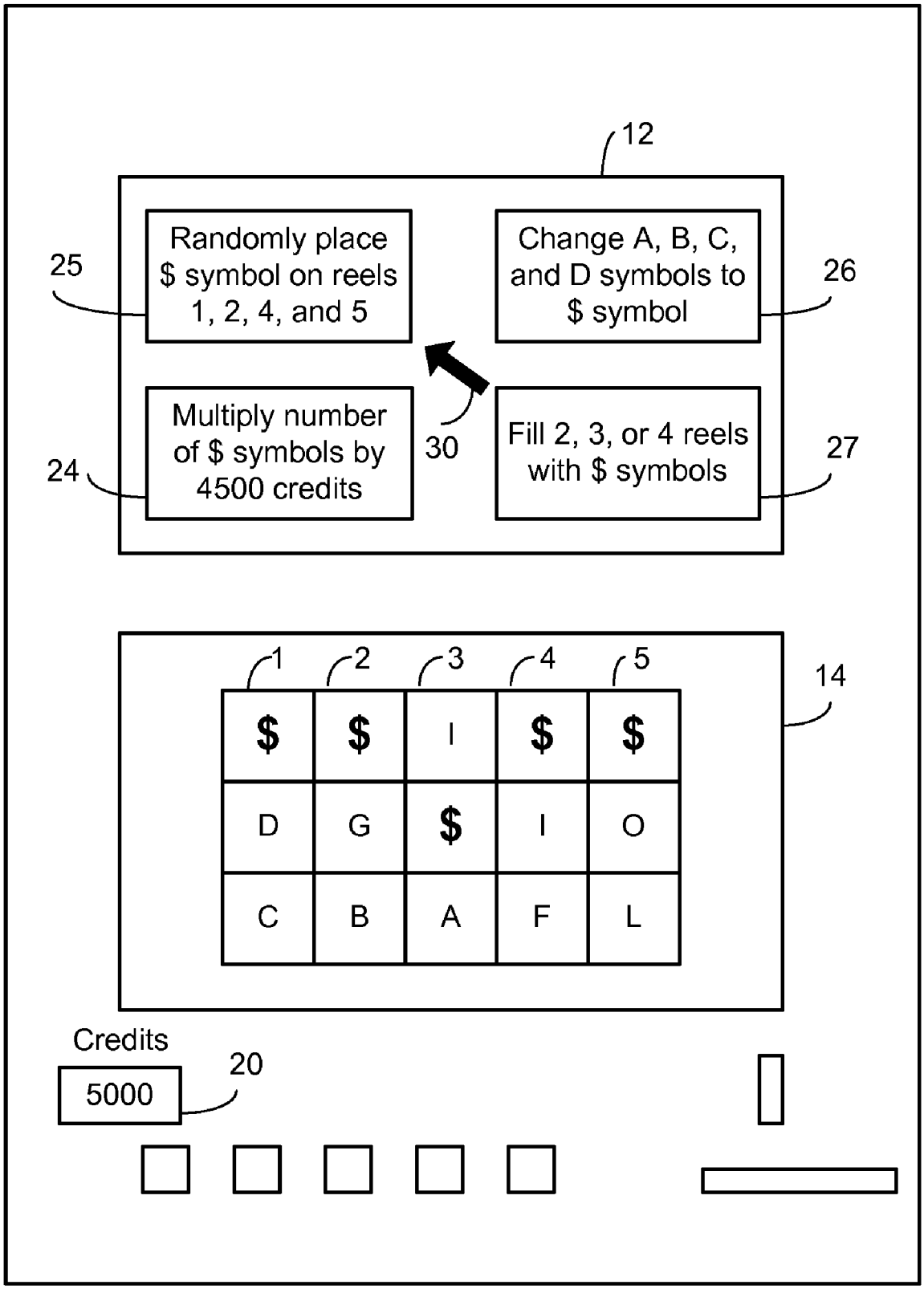
FIG. 4 illustrates the machine of FIG. 2 after another one of the four possible features is randomly chosen by the selector and the selected feature is applied to the existing array of symbols from the base game of FIG. 2.

FIG. 4 illustrates the same base game outcome as in FIG. 2 but where the spinner arrow 30 selected feature 25, which randomly places a $ symbol on each of reels 1, 2, 4, and 5. It will be assumed that four $ symbols across a payline wins 5000 credits. As shown in FIG. 4, the microprocessor has placed four $ symbols along the top horizontal payline, giving the player an award of 5000 credits, shown on the credit meter 20. There may be any number of possible paylines, including the three horizontal paylines and bent paylines. Typically, each payline includes only one symbol per reel.

Figure 5:
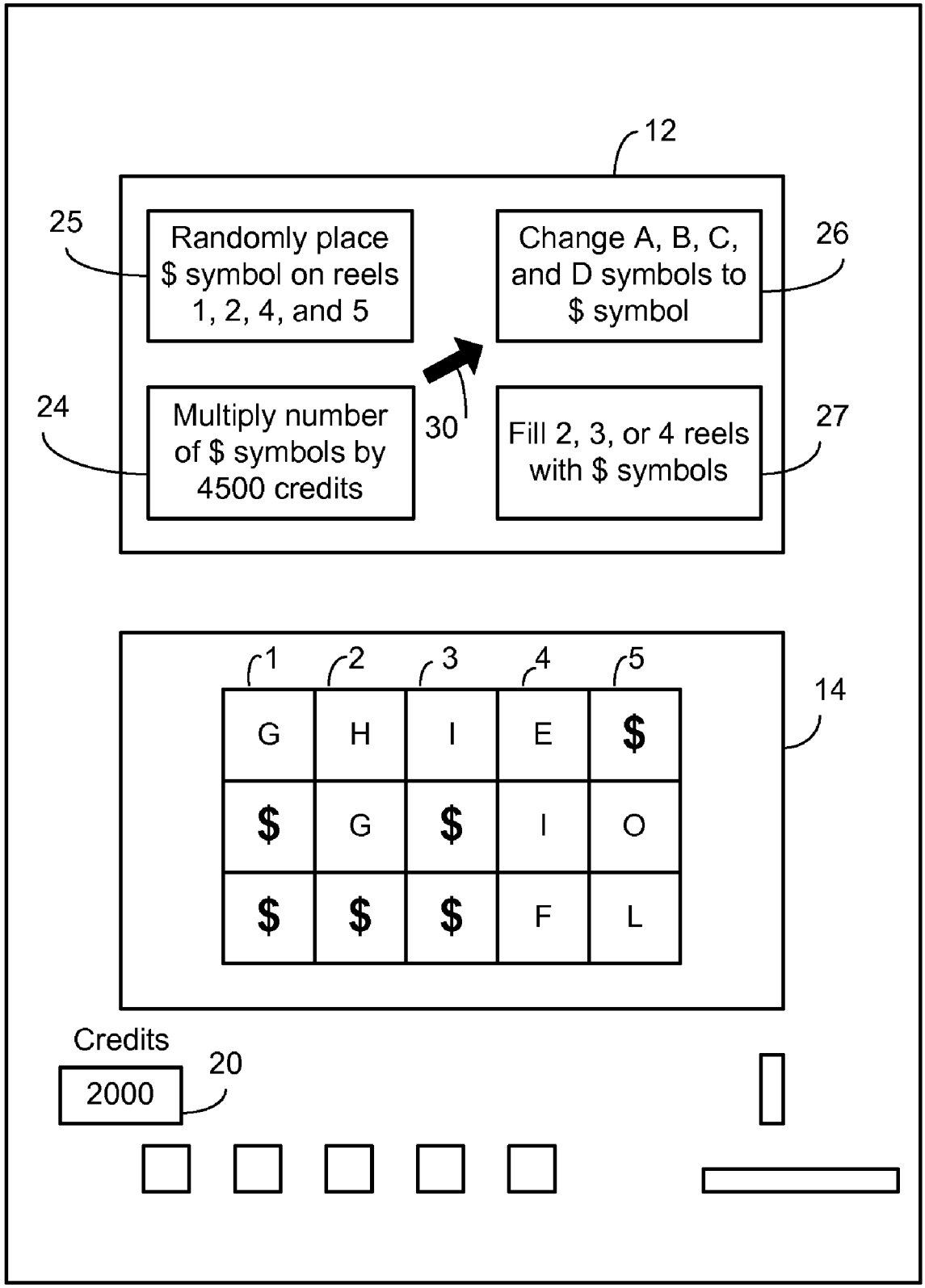
FIG. 5 illustrates the machine of FIG. 2 after another one of the four possible features is randomly chosen by the selector and the selected feature is applied to the existing array of symbols from the base game of FIG. 2.

FIG. 5 illustrates the same base game outcome as in FIG. 2 but where the spinner arrow 30 selected feature 26, which changes symbols A, B, C, and D to a $ symbol. The feature may even randomly select symbols to replace with the $ symbol once the feature is selected. It will be assumed that three $ symbols across a payline wins 2000 credits. As shown in FIG. 5, the microprocessor has substituted the symbols A, B, C, and D in the base game with $ symbols, so that three $ symbols appear across the lower payline, giving the player an award of 2000 credits, shown on the credit meter 20.

Figure 6:
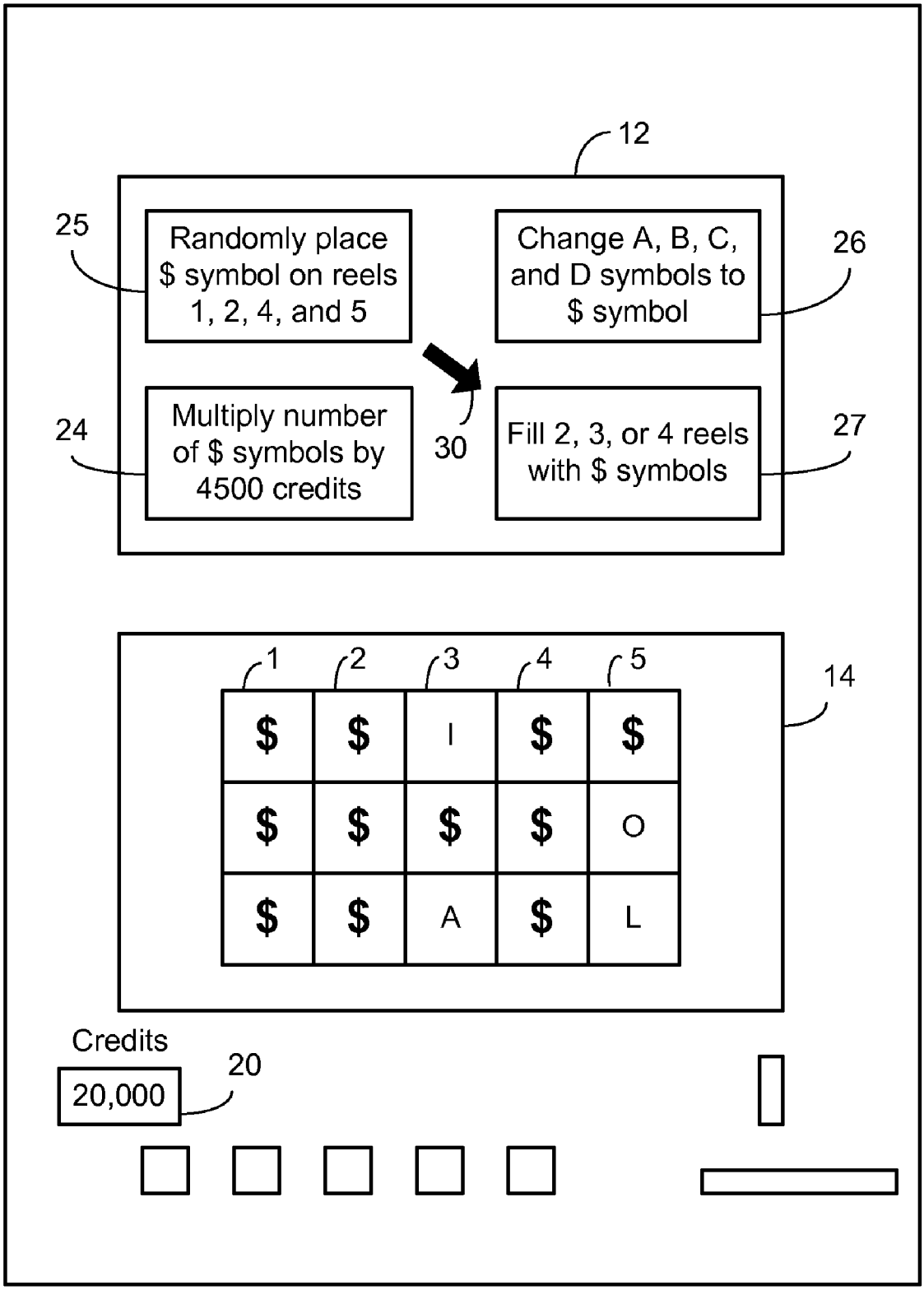
FIG. 6 illustrates the machine of FIG. 2 after another one of the four possible features is randomly chosen by the selector and the selected feature is applied to the existing array of symbols from the base game of FIG. 2.

FIG. 6 illustrates the same base game outcome as in FIG. 2 but where the spinner arrow 30 selected feature 27, which fills two, three, or four of the reels with the $ symbol. The reels are randomly selected by the microprocessor. In the example of FIG. 6, the microprocessor selected reels 1, 2, and 4 to fill with the $ symbol. As shown in FIG. 6, the player has four $ symbols across two paylines and three $ symbols across another payline, awarding the player 20,000 credits, shown on the credit meter 20.

Other features are possible, and the number of features that the microprocessor can select from may be more or less than four. In another embodiment, the player may attempt to stop the arrow 30 on one of the features by pressing a button or performing another task.

Any trigger event may be used to initiate the feature game, such as a special symbol combination or special symbols occurring in the array, or a mystery trigger that is not related to the displayed symbols. The mystery trigger may be randomly generated. Any type of gaming platform may be used. The gaming device or machine may even be a player's home computer communicating with a remote server via the Internet.

Figure 7:
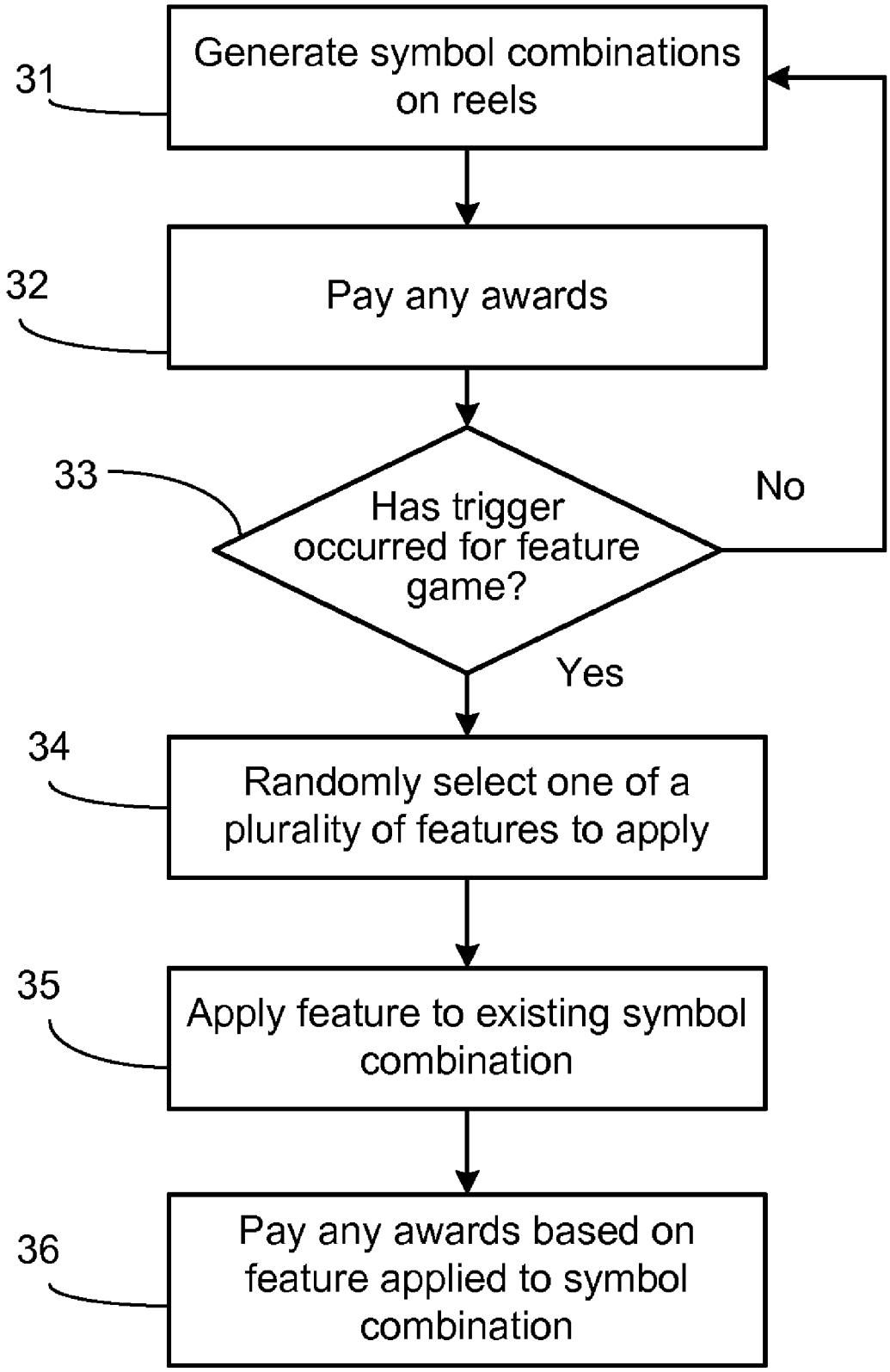
FIG. 7 is a flowchart of a method in accordance with one embodiment of the invention.

FIG. 7 is a flowchart of the basic steps in one embodiment of the invention. In step 31, after the player makes a bet and spins the reels, an array of symbols are generated in the base game. In step 32, any awards are paid for winning symbol combinations across activated paylines.

In step 33, it is determined by the microprocessor whether a trigger event has occurred. If not, the game is over.

If a trigger event has occurred, in step 34, the microprocessor randomly selects one of the possible features to apply to the current array of symbols in the base game.

In step 35, the selected feature is applied to the current array of symbols in the base game.

In step 36, any award as a result of applying the selected feature to the array of symbols is paid to the player.

Figure 8:
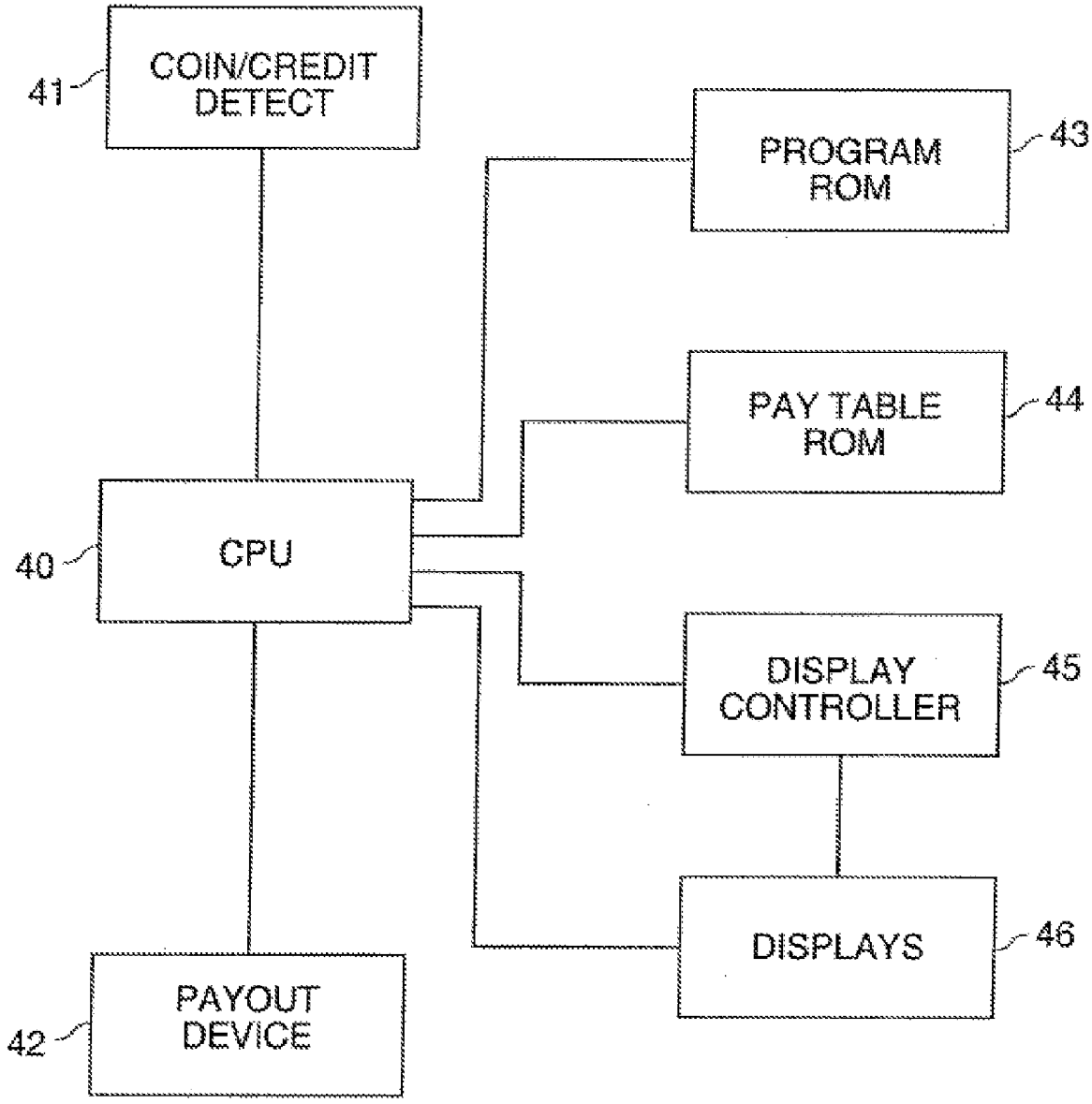
FIG. 8 is a block diagram of the main components in the gaming machine of FIG. 1.

FIG. 8 illustrates basic circuit blocks in a suitable gaming device. A control unit (CPU 40) runs a gaming program (including the invention) stored in a program ROM 43. The program ROM 43 may include a pseudorandom number generator program for selecting symbols and for making other random selections. A coin/credit detector 41 is sensed by the CPU 40 to determine if there are sufficient credits to play the game. A pay table ROM 44 detects the outcome of the game and identifies awards to be paid to the player. A payout device 42 pays out an award to the player in the form of coins upon termination of the game or upon the player cashing out. The payout may also be in the form of a coded paper ticket, credits on a smart card or magnetic strip card, or in any other form. A display controller 45 receives commands from the CPU 42 and generates signals for the various displays 46. If a display 46 is a touch screen, player commands may be input through the display screen into the CPU 40.

Instead of the gaming machine being a video gaming machine, the machine may use stepper-motor driven reels to select and display the symbol array. Such reel-type machines are processor controlled, and the reels simply display an array of symbols that have already been predetermined by the processor. The selection of features may be on a video screen or may involve a mechanical pointer pointing to the features.

While particular embodiments of the present invention have been shown and described, it will be obvious to those skilled in the art that changes and modifications may be made without departing from this invention in its broader aspects and, therefore, the appended claims are to encompass within their scope all such changes and modifications as fall within the true spirit and scope of this invention.

What is claimed is:

1. A method performed by a gaming device comprising:

displaying a first array of symbols in an array of symbol positions that have been randomly selected, certain combinations of symbols along one or more paylines providing an award for a player;

detecting a trigger event that initiates a feature game;

displaying a plurality of possible features that may be selected in the feature game, the possible features including replacing one or more of the symbols in the first array with particular symbols;

after the trigger event has been detected, randomly selecting one of the features to apply to the first array of symbols, wherein the selected feature causes one or more of the symbols in the first array to be replaced with the particular symbols;

applying the selected feature to the first array of symbols; and granting any award to a player based on the resulting combination of symbols after one or more of the symbols in the first array are replaced with the particular symbols in accordance with the selected feature, wherein the first array comprises symbols on five virtual reels, and wherein the plurality of features comprise randomly placing a first type of symbol on four of the reels at random positions on the reels.

2. A method performed by a gaming device comprising:

displaying a first array of symbols in an array of symbol positions that have been randomly selected, certain combinations of symbols along one or more paylines providing an award for a player;

detecting a trigger event that initiates a feature game;

displaying a plurality of possible features that may be selected in the feature game, the possible features including replacing one or more of the symbols in the first array with particular symbols;

after the trigger event has been detected, randomly selecting one of the features to apply to the first array of symbols, wherein the selected feature causes one or more of the symbols in the first array to be replaced with the particular symbols;

applying the selected feature to the first array of symbols; and granting any award to a player based on the resulting combination of symbols after one or more of the symbols in the first array are replaced with the particular symbols in accordance with the selected feature, wherein the first array comprises symbols on virtual reels, and wherein the plurality of features comprise multiplying the number of a first type of symbol displayed on the reels by an award amount.

3. The method of claim 2 wherein the trigger event comprises at least one first type of symbol appearing in the first array.

4. The method of claim 2 wherein the first array is a 5×3 array of symbols.

5. The method of claim 2 wherein randomly selecting one of the features comprises showing a selector ultimately identifying one of the features.

6. The method of claim 2 wherein the plurality of features is displayed on a screen that is separate from a screen displaying the first array.

7. The method of claim 2 wherein the trigger event is a particular display of one or more particular symbols in the first array.

8. A method performed by a gaming device comprising:

displaying a first array of symbols in an array of symbol positions that have been randomly selected, certain combinations of symbols along one or more paylines providing an award for a player, the first array being an N×M array on virtual reels, where N and M are each greater than one;

detecting a trigger event that initiates a feature game;

displaying a plurality of possible features that may be selected in the feature game;

after the trigger event has been detected, randomly selecting one of the features to apply to the first array of symbols;

applying the selected feature to the first array of symbols; and granting any award to a player based on the application of the selected feature to the first array of symbols, wherein the first array comprises symbols on five virtual reels, and wherein the plurality of features comprise randomly placing a first type of symbol on four of the reels at random positions on the reels by visually replacing symbols on the virtual reels with the first type of symbol while all remaining symbols on the virtual reels remain fixed in place.

* * * * *